United States Patent [19]

Rovin et al.

[11] 4,002,130

[45] Jan. 11, 1977

[54] AUTOMATIC BOBBIN REWINDING FOR SEWING MACHINES

[75] Inventors: Herman Rovin, Norwalk; Theodore Opuszenski, Darien; Joseph Pellicano, Greenwich; Alan F. Swenson, Norwalk, all of Conn.

[73] Assignee: Automatech Industries, Inc., Bridgeport, Conn.

[22] Filed: Sept. 22, 1975

[21] Appl. No.: 615,428

[52] U.S. Cl. ..... 112/180; 112/186

[51] Int. Cl.[2] ..... D05B 57/26

[58] Field of Search ..... 112/180, 186, 188, 196, 112/218 A, 231, 185, 184

[56] References Cited

UNITED STATES PATENTS

| | | | |
|---|---|---|---|
| 2,733,676 | 2/1956 | Schumann et al. | 112/180 |
| 3,115,110 | 12/1963 | Ketterer | 112/186 X |
| 3,125,973 | 3/1964 | Bernerus et al. | 112/186 |
| 3,308,776 | 3/1967 | Ivanko et al. | 112/186 X |
| 3,376,838 | 4/1968 | Schiffmacher et al. | 112/186 |
| 3,744,442 | 7/1973 | Michaels et al. | 112/186 |
| 3,747,547 | 7/1973 | Mayer et al. | 112/186 |

*Primary Examiner*—G. V. Larkin
*Attorney, Agent, or Firm*—Mandeville and Schweitzer

[57] ABSTRACT

The disclosure is directed to automatic bobbin rewinding for sewing machines. A two-station mechanism is provided enabling bobbins to be transferred from a winding position to a sewing position, with one bobbin being at all times in each position. When a bobbin is exhausted, that bobbin and its case are removed from the sewing machine and, simultaneously, a filled bobbin is removed from the winding position and combined with its case. The bobbin positions are then reversed, enabling the filled bobbin and its case to be inserted in the sewing machine, while the just-removed bobbin is separated from its case and inserted in the winding position. The filled bobbin remains attached to the main thread supply until it is inserted in the sewing position, enabling the thread to be guided and controlled until picked up by the sewing mechanism, thus avoiding the need for manual intervention. With the old bobbin in the rewind position, the remaining, unused thread is first extracted from it, and then the thread supply is guided into engagement with the empty bobbin in preparation for rewinding. The rewinding operation is carried out while the filled bobbin is being used in the sewing operation, so that there is continuity of operation of the sewing machine.

16 Claims, 12 Drawing Figures

AUTOMATIC BOBBIN REWINDING FOR SEWING MACHINES

BACKGROUND AND SUMMARY OF THE INVENTION

One conventional form of sewing machine requires, for effective operation, two separate supplies of thread, one leading directly into the sewing needle and the other supplied from a small bobbin located on the opposite side of the article being sewed. A so called lock stitch is formed by penetrating the article from one side with a length of thread, drawing enough thread through tc form a loop, passing the loop around the small bobbin to engage the bobbin thread, and then withdrawing the loop to form the lock stitch. Because the needle thread must be formed into a loop and passed around the bobbin, the bobbin must be of small diameter and thus necessarily contains a relatively limited supply of thread. Accordingly, in a high speed industrial sewing operation utilizing lock stitch techniques, it is necessary frequently to change bobbins as the bobbin in use becomes depleted of its thread supply. The used bobbins are, of course, rewound with new supplies of thread for subsequent use. The bobbin exchange and rewinding is a time consuming, repetitive operation which can significantly impair the efficiency of high speed sewing equipment. It is thus an objective of the invention to provide a mechanism which can be incorporated directly in a high speed sewing machine to effect automatic, high speed rewinding and exchange of bobbins.

One of the features of the invention resides in the provision of a noel high speed transfer mechanism, comprising a pair of transfer arms rotatable about an axis and also movable along the axis. The transfer arms are provided and combined with novel mechanisms which facilitate separation of the bobbin from the bobbin case, in the rewind position, while enabling the bobbin and bobbin case to be retained together in the sewing position. Among other things, this aspect of the mechanism includes a controllably actuated magnetic holder for separating the bobbin from its bobbin case, the case being retained by the transfer arm. In this connection, the transfer arm itself includes an advantageous form of mechanism which simultaneously grips the bobbin case and releases the mechanical locking means by which the bobbin normally is secured in the sewing machine.

During execution of a bobbin reloading operation, one of the steps involves reassembling the freshly wound bobbin into its bobbin case and guiding the thread underneath the bobbin case tension spring. The mechanism of the invention includes novel and relatively simplified facilities for accomplishing this objective on a reliable, automatic basis.

In order to avoid the need for manual intervention in the bobbin exchange process, it is necessary to maintain control at all times over the thread supply, not only to enable the thread to be properly engaged with the bobbin case tension spring, as just described, but also to enable the thread to be brought into the proper position relative to the sewing mechanism, where the bobbin is inserted in the sewing position. Thus, as another objective of the invention, provision is made for maintaining the thread end, extending from the bobbin case tension spring, under complete control throughout the bobbin exchange process and placing it in a predetermined position relative to the sewing mechanism, upon completion of the exchange. To advantage, this is accomplished by effecting the bobbin transfer manipulations while the filled bobbin is still connected to the primary thread supply. As the bobbin and bobbin case are manipulated from the winding position to the sewing position, the attached thread moves with the freshly wound bobbin and is picked up by strategically placed guide elements. When the newly wound bobbin is finally inserted in the sewing position, the trailing thread is positioned in a predetermined control path where it can be clamped, cut, positioned for sewing and also reengaged with the empty bobbin for a subsequent rewinding cycle.

In accordance with another feature of the invention, a novel and highly simplified arrangement is provided for enabling the rewinding of a new bobbin to commence without manual intervention. To this end, the invention includes a slightly modified form of bobbin, provided with a thread pick up slot, in conjunction with a movable thread guide. The latter engages a section of thread in the span leading from the primary supply, around the control path and up to the freshly wound bobbin in the sewing machine. When the rewinding operation is ready to commence, the thread guide is actuated in a manner to press the control thread against the end face of the bobbin, passing it through the pick up slot and causing the thread to be engaged by the rotating bobbin for rewinding.

In accordance with another feature of the invention, improved overall sewing efficiency is achieved by effecting a bobbin reload before the bobbin in use is fully exhausted of its thread supply. This prevents from running out of bobbin thread in the middle of a sewing operation and possibly resulting in a defective product. While this is of course a widely used technique, it is an objective of the invention to enable the technique to be utilized in a two bobbin, automatic rewind system forming an effectively integral part of the sewing machine. To this end, the system of the invention includes provisions for initially reversely rotating the bobbin when it is in the rewind position, in conjunction with a vacuum nozzle for extracting unused thread. Thus, in a sequence of operations with the mechanism of the invention, the used bobbin, after separation from its bobbin case and mounting in the rewind position, is reversely rotated while the excess thread is extracted by vacuum. The bobbin is then rotated in a winding direction and the rewind thread guide is actuated to cause the control thread to be engaged with the bobbin pick up slot.

A further feature of the invention is the provision of automatically operative means for separating and disposing of the short span of control thread which extends from the rewinding position to the sewing position after completion of a bobbin exchange manipulation.

For a better understanding of the above and other features and advantages of the invention, reference should be made to the following detailed description and to the accompanying drawings.

DESCRIPTION OF A PREFERRED EMBODIMENT

Figure 1:
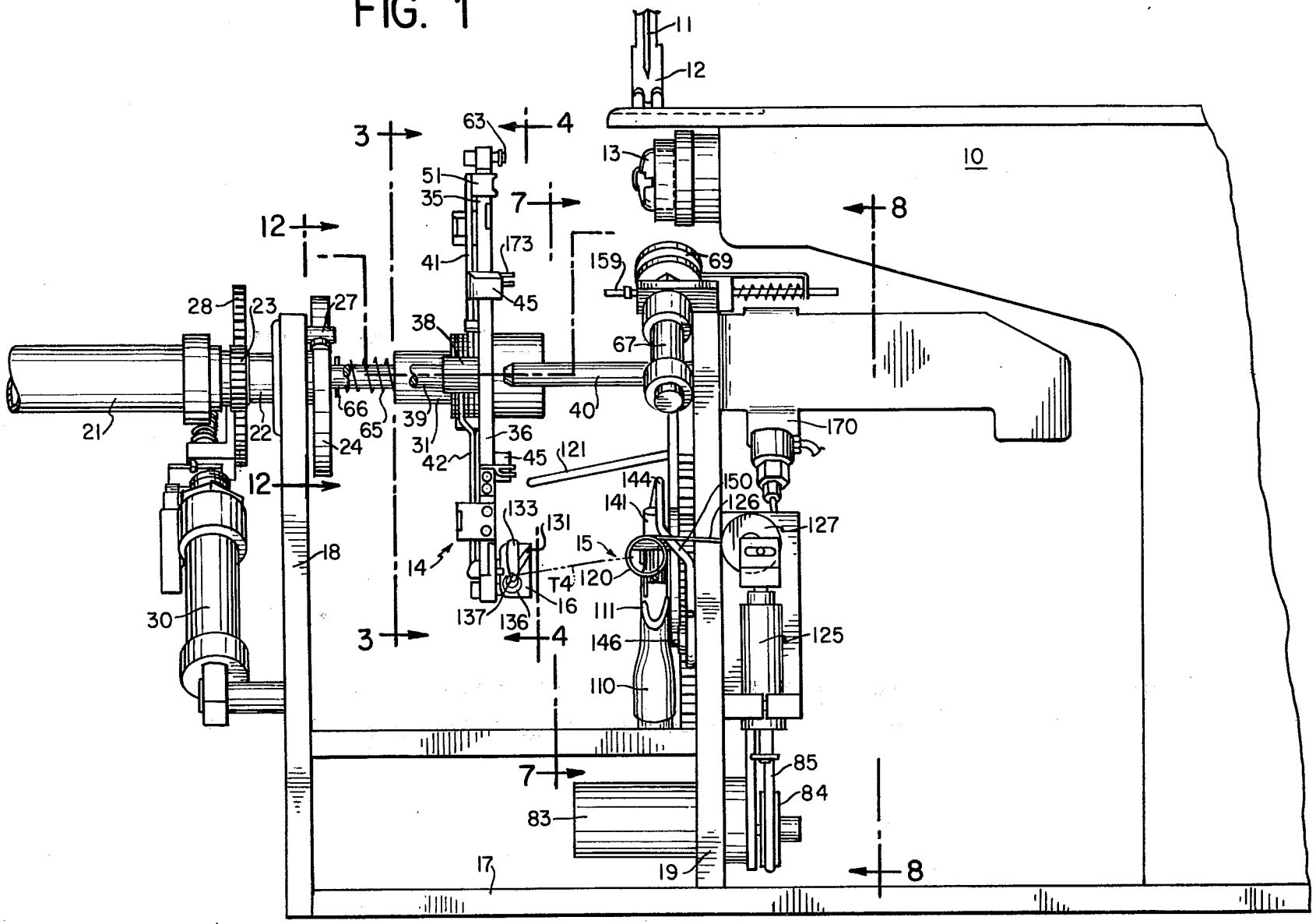
FIG. 1 is a side elevational view of a bobbin rewind and exchange mechanism according to the invention, as installed in conjunction with a typical industrial sewing machine.
Figure 2:
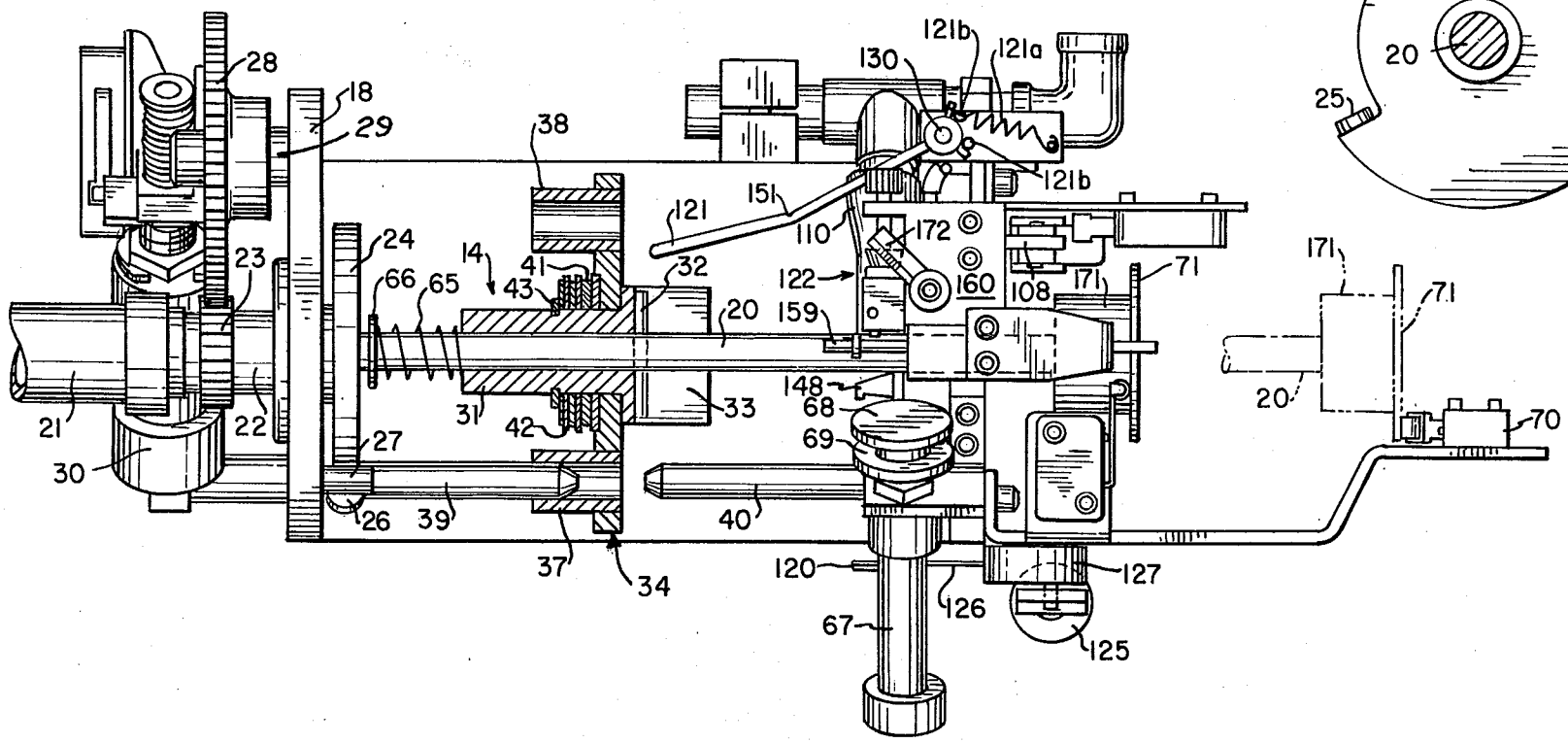
FIG. 2 is a top plan view, partially in section, of the mechanism of FIG. 1.

Referring now to the drawings, and initially to FIGS. 1 and 2 thereof, the reference numeral 10 designates generally the base of a conventional industrial sewing machine, illustrating the location of the needle and presser foot 11, 12 and the operative position of a bobbin and bobbin case, designated by the reference numeral 13.

By way of a generalized and simplified description of the functioning of the new apparatus, a rotatable transfer arm assembly 14 is arranged, at a predetermined time in the sewing operation, to advance to the bobbin and bobbin case 13, extract them from the sewing machine, rotate through 180°, and insert a newly filled bobbin and its case into the sewing position. The just-used bobbin is then located at the rewind position, generally designated by the numeral 15 in FIG. 1, having been separated from its bobbin case 16. By means to be described, the new bobbin is automatically refilled and ready for a further cycle of operations in the sewing operation. When the next bobbin in nearly exhausted, a further exchange occurs.

Many of the generalities of the sequence of operation of the herein described apparatus are reflected in the Bernerus et al U.S. Pat. No. 3,125,973. The system and apparatus of the present invention, however, incorporate significant refinements and improvements with respect to the mechanisms of the Bernerus et al patent, such that the overall mechanism is greatly simplified and its operation made more useful.

Referring still primarily to FIG. 1, the apparatus of the invention includes a frame base 17, attached to the front of the sewing machine 10, below the sewing head, and having a pair of spaced, vertical frame plates 18, 19. A transfer shaft 20 is slideably supported in the frame members 18, 19 and is connected at its outer or forward end to a fluid cylinder 21, which is suitably fixed to the frame structure against axial movement but is rotatable, along with the shaft 20, as will appear.

Figure 12:
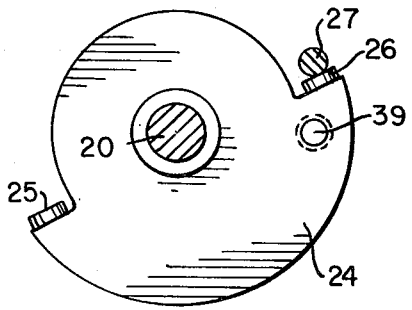
FIG. 12 is a cross sectional view as taken generally on line 12—12 of FIG. 1.

A sleeve 22, fixed to the forward end of the cylinder 21, surrounds a portion of the shaft 20 and is rotatably journaled in the outer frame plate 18. The sleeve 22 mounts a pinion 23 at one end and a position stop cam 24 at the other end. The cam 24, shown in FIG. 12, is provided with a pair of abutment stop surfaces 25, 26 arranged for engagement with a stop pin 27 carried by the frame plate 18. The arrangement is such as to provide the sleeve 22 with a 180° range of rotation between fixed stop positions in which either of the abutment stops 25 or 26 engages the stop pin 27.

For driving the sleeve 22, a gear 28 is journaled on a short axle 29 carried by the outer frame plate 18. A fluid cylinder 30 is eccentrically connected to the drive gear 28, such that extending and retracting movements of the actuating cylinder 30 will rotate the drive gear through a portion of a revolution, sufficient to drive a pinion 23 and sleeve 22 through 180° of rotation between the desired stop positions.

Figure 3:
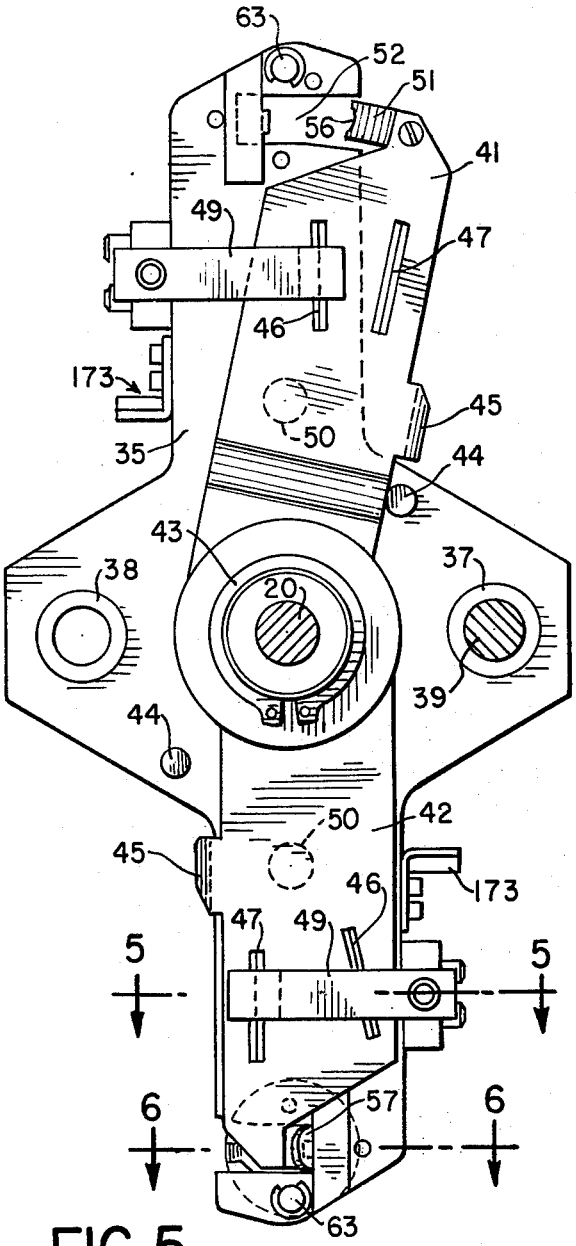
FIGS. 3 and 4 are cross sectional views as taken generally on lines 3—3, 4—4 of FIG. 1.
Figure 4:
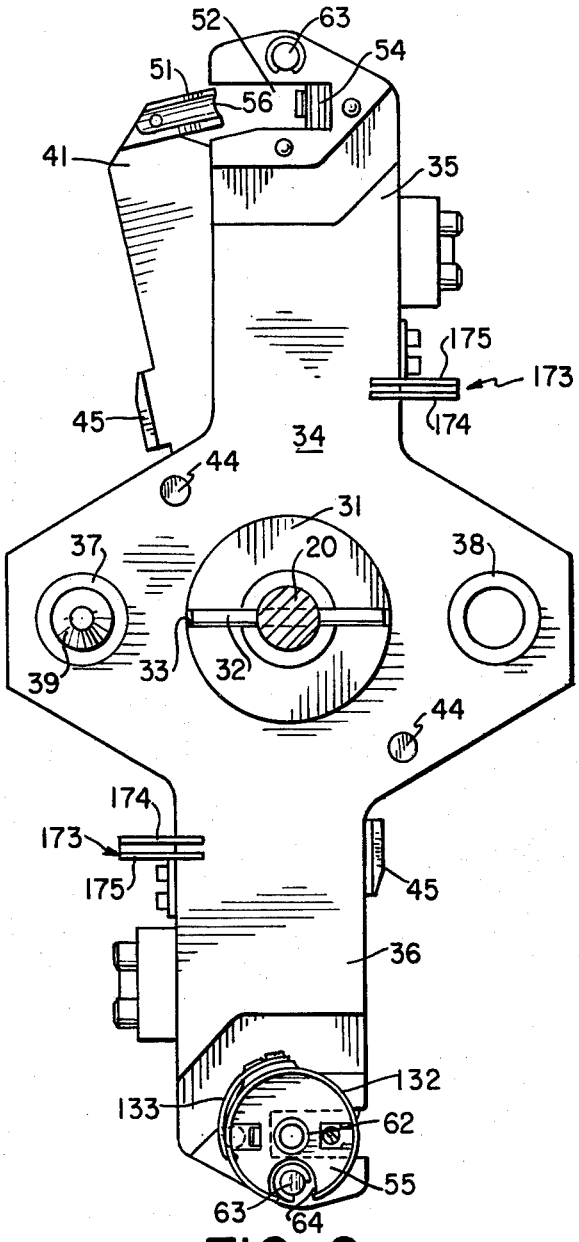

Received slideably on the transfer shaft 20 is the transfer arm assembly 14. This assembly includes a hub sleeve 31, which is slideably supported on the transfer shaft 20, but is keyed thereto for rotation, by means of a pin 32 extending through the shaft and received in an axially elongated slot-like recess 33 in the hub sleeve. A primary transfer arm member 34 (see FIGS. 3 and 4) is fixed to the hub sleeve 31 and has outwardly extending carrier arms 35, 36. The transfer arm assembly is also provided with a pair of diametrically opposed guide bushings 37, 38 arranged at appropriate times to be received over guide pins 39, 40 (see FIG. 2).

Associated with each of the carrier arms 35, 36 is a locking lever 41, 42, mounted on the hub sleeve 31 for limited rotational movement. If desired, friction washers may be utilized in conjunction with the lock arms, with the entire assembly being secured in place by means of a retainer clip 43. Each lock arm cooperates with a stop pin 44 to limit pivoting or rotational movement in the "opening" direction, whereas movement in the closing direction is limited by rearwardly extending lugs 45, which engage the sides of the carrier arms 35, 36. As reflected in FIGS. 3 and 5, the carrier arms 35, 36 are notched at 46, 47 to receive a detent element 48 carried by a leaf spring 49, releasably securing the locking levers in either of their respective stop positions until forcibly moved therefrom. To advantage, a spacer pad 50 of low friction material is received in each of the carrier arms 35, 36, in the region opposite the detent element 48 to assist in guiding and supporting the locking levers. Each of the locking levers carries a lifting cam 51 at its outer end, which is receivable in an open slot 52 in the end of a carrier arm. As shown in FIG. 6, the base of the open slot 52 is formed by an inclined surface 53, forming an angle of about 60° or so with the principal flat surfaces of the carrier arms. The lifting cam elements 51, carried by the respective locking levers 41, 42, are provided with similar inclined surfaces 54.

As reflected in FIG. 6, the arrangement of the respective inclined surfaces 53, 54 is such that when a carrier arm 36 is brought into loading position with respect to a bobbin case 55, and the locking lever is actuated from an open position to a closed position, the forward tip 36 of the lifting cam 51 will engage the upturned end 57 of the latch lever 58 of the bobbin case. Continued closing movement of the locking lever 42 causes the bobbin latching lever 58 to be lifted to the position shown in FIG. 6 and gripped between the lifting cam 51 and the surface 53 of the carrier arm. A small in-turned lug 59, carried by the carrier arm, is positioned to be received within a small opening 60 in the bobbin latching lever 58, to help align and secure the lever in its locked position.

As can be appreciated from FIG. 6, when the bobbin latching lever 58 is engaged and lifted by the cam 51, not only is the bobbin case secured and locked to the carrier arm 36, but the latching slide 61 of the bobbin case is thereby moved to a position to free the bobbin case from the sewing machine. In this respect, the bobbin and bobbin case mechanisms utilized herein are substantially conventional with certain slight modifications. One such modification is the provision of a slightly exaggerated upturned lip 57 on the bobbin case latching lever 58, to facilitate the initial engaging and lifting action of the lifting cam 51. In a conventional bobbin and bobbin case assembly, the bobbin case is secured in the sewing machine by means of a latching slide 61, which is received over a latching pin (not shown) in the sewing machine and extending through the tubular hub 62 in the bobbin case. The latching slide 61 engages itself in an annular groove in the outer end of the latching pin. When the bobbin case lever 58 is pivoted outwardly, the latching slide 61 moves laterally, to free itself from the latch pin groove and permit the bobbin case to be extracted from the machine. Thus, in the illustrated arrangement, when the lifting cam is moved to its closed position, the bobbin case is not only released from the sewing machine, but is gripped by the lever 58, enabling the bobbin case to be withdrawn from the sewing machine by a retracting movement of the carrier arm.

In order to retain the bobbin in its bobbin case, during advancing, retracting and rotational movements of the transfer arm assembly 14, each of the carrier arms 35, 36 is provided in its outer end portion with a magnet bar element 63, which is arranged to project slightly rearward from the face of the carrier arm and through an opening 64 (see FIG. 4) provided in the bobbin case 55. The projecting end face of the magnet 63 is positioned to engage or lie immediately adjacent to the end flange of a bobbin (not shown) in the bobbin case, such that the bobbin tends to stay with the bobbin case when the case is locked in the transfer arm. In this respect, it is understood that the bobbin is conventionally constructed of a ferrous, magnetic material.

The desired rotational and advancing and retracting movements of the transfer arm assembly 14 are facilitated by the guide pins 39, 40, one or the other of which is engaged with one or the other of the guide bushings 37, 38. When the transfer shaft 20 is in its retracted position, the transfer arm assembly 14 is retracted with it, by means of the pin 32, the slide hub 31 being normally urged up against the pin 32, by means of a spring 65 acting against a collar 66 carried on the transfer shaft. Rotation of the transfer shaft from one operative position, to another operative position 180° away, is accomplished by energizing the fluid actuator 30 to retract, to rotate the pinion 23, sleeve 22 and stop cam 24 in a clockwise direction (viewed looking toward the sewing machine from in front). The guide pin 39 is carried by the stop cam 24 and is of such a length as to engage one of the guide bushings when the shaft 20 and transfer arm assembly 14 are in their retracted positions. Thus, when the stop cam 24 is rotated, the retracted transfer arm assembly rotates along with it.

After the stop cam 24 has been rotated from the first to the second of its limit positions, the transfer actuator 21 may be extended to advance the transfer shaft 20 and the transfer arm assembly 14. This advancing movement causes the appropriate guide bushing 38 to slide off of the guide pin 39 and onto the guide pin 40, which is fixed, and serves to accurately align the transfer arm assembly for pickup or deposit, as the case may be of a bobbin case and/or bobbin. After the transfer arm reaches its limit position, the transfer shaft 20 continues in its advancing motion, with the necessary over travel being provided by compression of the spring 65. Certain control functions are accomplished by this over travel motion, as will be hereinafter described. Among these are that the actuator 30 returns to its extended condition, returning the position stop cam 24 to its original position while leaving the transfer arm assembly locked to the guide pin 40. During this return rotation, the pin 32 is out of the slot 33, by reason of the rearward over travel of the transfer shaft 20.

In a contemplated series of bobbin exchange operations, when an exchange sequence is commenced, the upper carrier arm has an open locking lever. The transfer arm assembly moves into bobbin case-engaging position with respect to the sewing machine, and the open locking lever is moved to a closed position, to engage the bobbin case and release it from the sewing machine, in the manner illustrated in FIG. 6. The desired closing movement of the locking lever is accomplished by means of an actuating cylinder 67 having an annularly recessed operator 68 at its outer end. When the transfer arm assembly is moved to its fully advanced position, the projecting lug 45 of the locking lever is received in the groove 69 of the operator 68, whereupon the actuator 67 may be extended to close the locking lever and engage the bobbin case.

To advantage, the over travel motion of the transfer shaft 20 may be utilized to actuate a control switch 70, by means of a disc like operator 71 carried at the end of the transfer shaft. By means of suitable sequencing switch controls, not specifically shown but of conventional design, the actuator 67 is arranged to remain extended until a second phase of the exchange cycle, in which a newly filled bobbin and bobbin case assembly is brought into loading position in the sewing machine. In this second phase of the cycle, actuation of the switch 70 by the operator 71 serves to retract the actuator 67 and thereby move the locking lever to its open position, releasing the bobbin case from the transfer arm and causing it to be locked onto the spindle of the sewing machine.

Thus, considering the operations of the mechanism only at the sewing machine station, the transfer arm mechanism first is operated to move into the sewing machine station, close the locking lever to release the bobbin case from the sewing machine and lock the bobbin case into the transfer arm. The transfer arm is then retracted, the bobbin being carried along with the bobbin case by means of attraction of the magnetic pin element 63. The transfer arm is retracted back to the position in which the pin 39 is engaged with the appropriate guide bushing, and the actuator 30 is energized in a retracting direction, to swing the transfer arm clockwise through 180°, bringing a newly filled bobbin and bobbin case into the upper position. The transfer actuator 21 is then again actuated, advancing the transfer arm assembly 14 into the sewing machine load position, inserting the filled bobbin and bobbin case in the desired position. Immediately thereafter, the locking lever is released by retraction of the actuator 67, enabling the transfer arm to be retracted again, this time without the bobbin case. The management of the thread end, throughout the sequence of transfer operations, forms an important part of the overall sequence, which will be described in detail hereinafter.

Considering now the sequence of transfer operations at the bobbin rewind station 15, it is to be understood initially that, when a filled bobbin and bobbin case are loaded into the sewing machine at the upper station, an empty bobbin is deposited at the bobbin rewind station 15, while the bobbin case is separated therefrom and retained by the lower carrier arm, as shown in FIG. 1. To this end, the lower or rewind station has no provision for engaging the bobbin case, which remains secured at all times to the transfer arm assembly. However, the bobbin spool, which is retained in the transfer arm assembly only by the relatively weak magnetic attraction of the pin 63, is attracted to the rewind position by a superior magnetic attraction, enabling the bobbin to be separated from its case and rewound. When it is desired to reengage the filled bobbin with the bobbin case, the superior magnetic force is temporarily disenabled, such that the bobbin spool is released and can again be retained in the transfer arm assembly by the magnetic pin 63.

Figure 9:
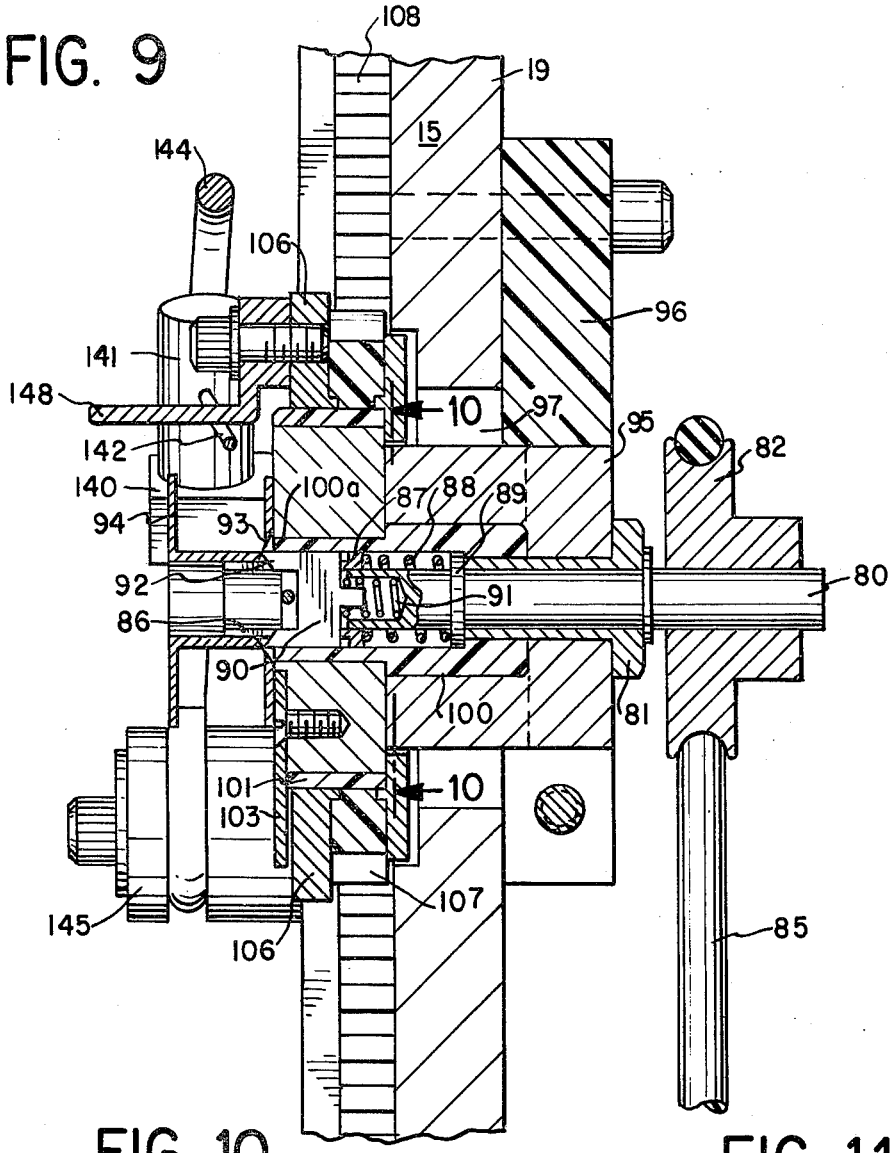
FIG. 9 is a cross sectional view as taken generally on line 9—9 of FIG. 7.
Figure 10:
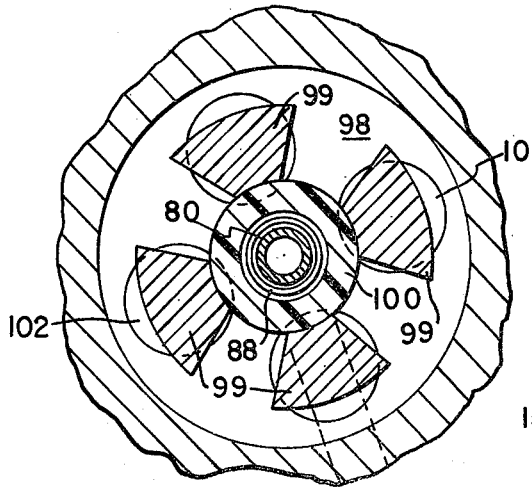
FIG. 10 is a fragmentary cross sectional view as taken generally on line 10—10 of FIG. 9.

With reference now particularly to FIGS. 9 and 10, the bobbin rewind mechanism is shown to be mounted on the frame plate 19 and includes a winding shaft 80 journaled in a bushing 81 and carrying a drive pulley 82 at its rearward end. A high speed reversible motor 83 drives the pulley 82, through a pulley 84 and belt 85. At its outer end, the rewind shaft 80 slideably supports a pilot sleeve 86 having an outwardly extending flange 87 at its inner end. A spring 88 acts between the flange 87 and similar flange 89 on the rewind shaft, to urge the pilot sleeve 86 in an extending direction. A bobbin clutch key element 90 is slideably received and supported in the outer end of the rewind shaft 80 and pilot sleeve 86, being urged outwardly by a light spring 91. The clutch key has outwardly projecting fingers 92 engageable in short radial slots 93 provided as a special modification in the hub area of the bobbin spool 94. The arrangement is such that when the lower station of the transfer arm mechanism approaches the rewinding station 15, the bobbin spool 94 is received on the pilot sleeve 86. Typically, the bobbin slots 93 will not be initially engaged with the fingers 92 of the clutch key, so the latter is permitted to retract against the pressure of the spring 88. Subsequent relative rotation between the rewind shaft 80 and the bobbin spool will cause the clutch fingers to become engaged, as will be understood.

In order to secure the bobbin spool 94 firmly in the rewind station for the rewinding operations, a powerful, four pole permanent magnet element 95 is mounted to the frame plate 19, advantageously being carried on a nonmagnetic mounting member 96 and projecting through an enlarged opening 97 in the frame plate itself. In the illustrated arrangement, the magnetic element is in the form of a cup shaped member, provided with radial slots 98, forming four evenly spaced magnetic poles 99. A magnetic switching means is provided in the form of a plastic matrix rotatably received in the internal cup portion of the magnetic element and having a front flange area 101 in which are embedded a series of four magnetic conductors 102. The matrix 100 is arranged to be rotatable relative to the primary magnetic element 95 such that the magnetic conductors are alternatively either aligned with the magnetic poles 99 or with the spaces 98 therebetween. When the magnetic conductors and magnet poles are aligned, the bobbin case 94 is attracted strongly to the magnetic conductors. However, by rotating the magnetic conductors into alignment with the gaps 98, the magnetic attraction of the spool is very weak and is easily overcome by the combined action of the spring 88 and the relatively weak magnetic element 63 of the transfer arm.

Figure 7:
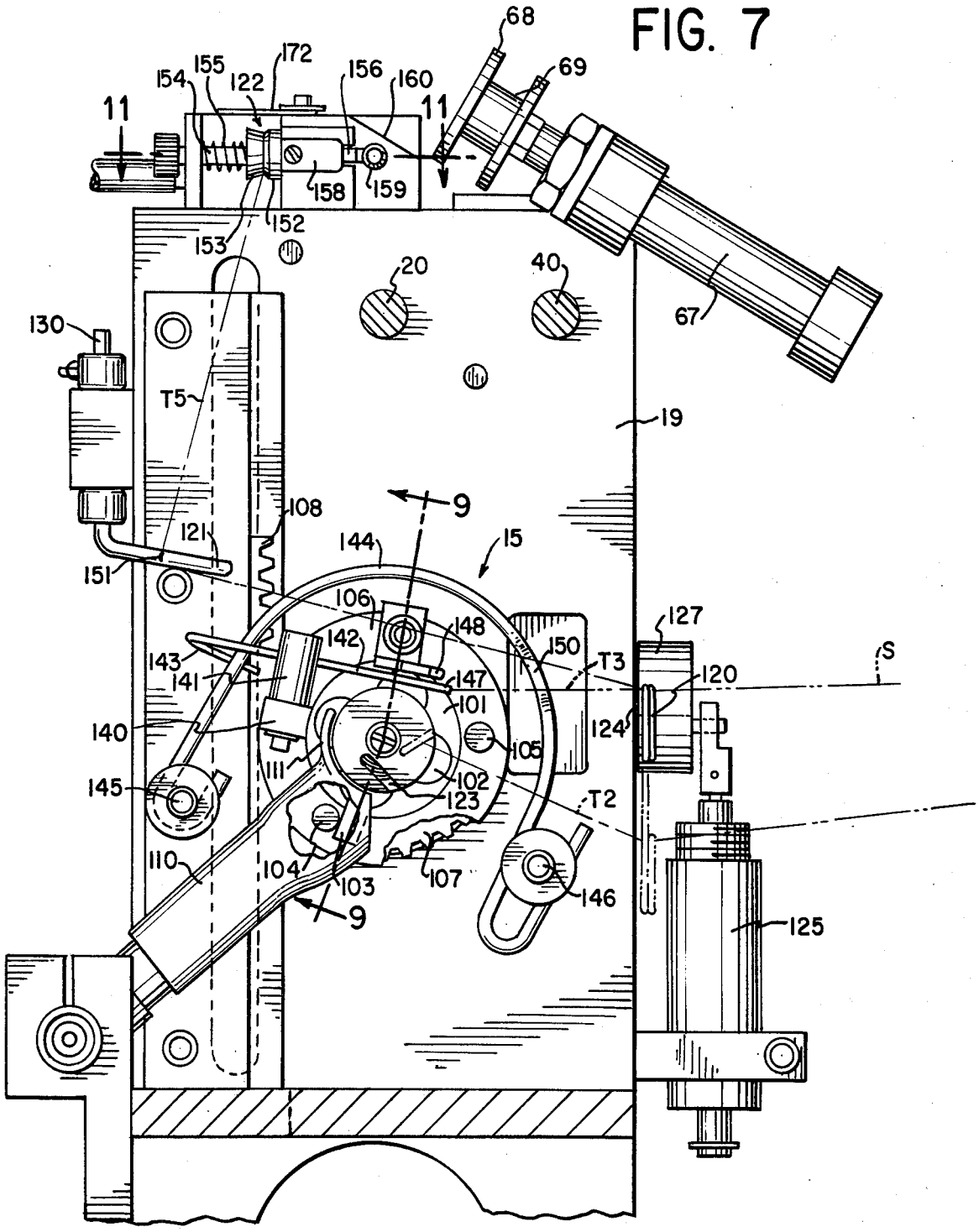
FIGS. 7 and 8 are cross sectional views as taken generally along lines 7—7, 8—8 respectively of FIG. 1.
Figure 8:
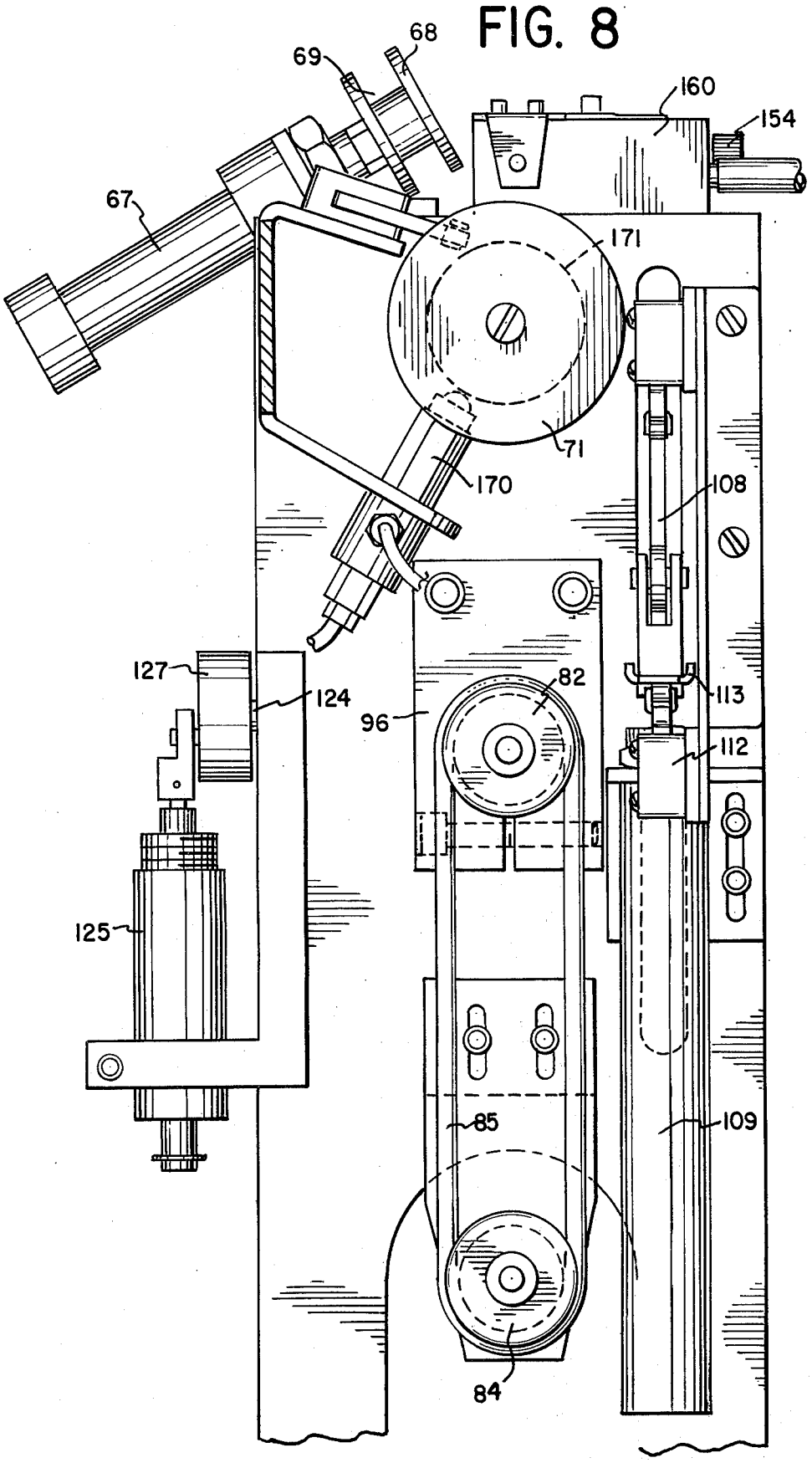

Control over the magnetic switch means desirably is accomplished by means of a control arm 103 (see FIG. 7) which extends radially from the rotatable magnetic switch element. This control arm is engageable alternatively by one or the other of a pair of stop pins 104, 105 carried by a control ring 106 secured to a gear 107. A rack 108 is guided slideably in a vertical slot in the frame plate 19 and is driven by an actuator 109 (see FIG. 8) through a vertical operating stroke. Referring to FIG. 7, the magnetic switch is shown in position with the conductors 102 aligned with the poles 99, for retaining a spool in winding position. When the gear 107 and ring 106 are driven in a clockwise direction, the control ring 106 will rotate through approximately 90° of rotation, before the control arm 103 is initially engaged by the stop pin 105. Further continued rotation of the ring 106 for another 45° will rotate the magnetic switch element to bring the magnetic conductors 102 from a position of alignment to a position of non-alignment with the magnetic poles 99 to release the spool. Subsequent actuation of the rack 108 in the reverse direction will similarly result in about 90° of lost motion of the control ring 106 before the stop pin 104 engages the control arm and commences to move it sufficiently (45°) to align the magnetic conductors with the gap areas 98. The additional function of the control ring 106 will be described hereinafter.

The manipulation of a bobbin spool 94 at the rewind station involves advancing the transfer arm assembly 14 with a gripped bobbin case and empty bobbin. When the transfer arm assembly is fully advanced, the over travel motion of a shaft 20 and actuation of the switch 70 results in the actuator 109 driving the rack 108 downward, rotating the magnetic switch counterclockwise to align the magnetic conductor with the magnetic poles, and thereby strongly attracting the bobbin 94 to the winding position. The bobbin is thus extracted from the bobbin case when the arm assembly 14 is retracted, the much more powerful magnetic influence of the large magnet element 95 easily overcoming the weaker force of the magnetic pin 63.

In accordance with one of the advantageous aspects of the invention, the sewing operations are so conducted as to call for a bobbin reloading sequence to be initiated before the bobbin in use is completely exhausted of its thread. This assures that the sewing machine will not be exhausted of bobbin thread in the middle of sewing of an article, resulting in a defective piece. To this end, means are provided for extracting from the used bobbin the residual unused thread that remains when the sewing sequence is terminated. With reference to FIGS. 1 and 7, a vacuum tube 110 is provided, having a suction lip 111 embracing a portion of the spool. Immediately after a bobbin is mounted in the rewind position, the vacuum tube 110 is energized, and the rewind motor 83 is driven in a reverse direction so that the residual thread is unwound from the spool and drawn off through the vacuum tube 110. This sequence conveniently can be initiated by means of a switch 112, actuated by an operator 113 at the end of a downward stroke of the fluid cylinder 109 which drives the rack 108. Suitable timing means may be provided to establish a short reverse rotation period for the bobbin spool 94, adequate to assure complete removal of the residual thread, after which the rewinding motor 83 is automatically reversed and driven at high speed in the winding direction.

Desirably, the plastic matrix 100 is formed to provide a slight annular extension 100*a* of low friction material, which functions as a bearing for the spool 94 during rewinding operations.

In normal operation of the equipment, a supply of thread is derived from a large cone or other bulk supply, brought through a thread tensioning device (not shown), of conventional type. At the time of loading of an empty bobbin into the rewinding station, the thread supply, shown in FIG. 7, extends from the source S through an upraised circular thread guide wing 120, above the spool, around a guide finger 121 and up to a thread clamp 122. Automatic starting of the bobbin winding operation is enabled by providing an angular slot 123 in the outer flange of the bobbin spool. The angular slot, as shown in FIG. 7, extends from the outer edge of the spool flange, to a point near the core of the spool. When the bobbin spool is driven in the winding direction, after removal of the residual thread, the thread guide 120 is momentarily depressed, to carry the span of the thread supply from a position above the bobbin spool to a position across and pressing inward against the end free of the spool. This is accomplished by pivotally mounting a thread guide 120 for downward and inward pivoting movement about a shaft 124, by means of an actuator 125. As shown best in FIG. 1, the circular thread guide 120 is carried on the end of a spring arm 126 which is in turn mounted on a circular block 127 carried by the shaft 124. When the actuator 125 is extended, the block 127 is rotated counterclockwise causing the thread guide 120 to move downward and inward through an arcuate path. As the thread span, designated in FIG. 7 by a letter T2, is pressed against the face of the counterclockwise rotating bobbin spool, the thread is automatically picked up by the open slot 123. Continued rotation of the bobbin spool causes thread to be drawn from the supply and wound on the spool in the manner desired. The thread guide 120 can then be returned to its raised position.

When a bobbin winding operation commences, there is a section of residual thread, which extends from the base of the slot 123 to and around the guide finger 121 and up to the clamp 122. Separation of this thread section from the bobbin 94 is effected by mounting of the guide finger 121 for very limited rotational movement resisted by a spring 121*a* and limited by stop pins 121*b* (FIG. 2). Thus, with one end of the residual thread secured in the clamp 122, rotation of the bobbin spindle 94 causes an eccentric motion of the residual thread section, which is accommodated by limited rotational displacement of the thread guide 121 about the vertical axis of its upper end section 130. The inertia and yieldable resistance of the guide finger 121, to the tendency of the thread section to rapidly reciprocate under high speed rotation of the bobbin spool 94, causes the thread section to quickly fray and rupture at the base of the bobbin slot 123. Thus, at the completion of a bobbin winding operation, the bobbin is connected only to the thread section T2 extending back to the thread supply.

At the commencement of a bobbin exchange sequence, while the upper end of a transfer arm mechanism is engaging and removing the empty bobbin and bobbin case from the sewing machine, the lower portion of transfer arm functions to reunite the filled bobbin with its bobbin case and to properly thread the bobbin case. A first step in this sequence is for the transfer arm assembly to be advanced, placing the empty bobbin case over the filled bobbin.

Figure 5:
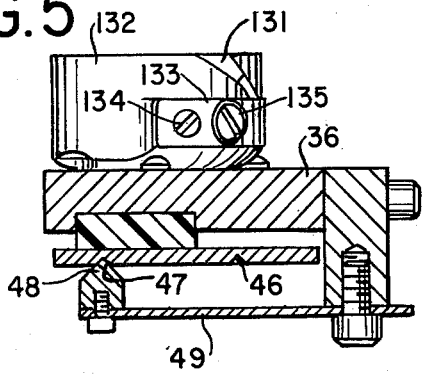
FIGS. 5 and 6 are cross sectional views as taken generally along lines 5—5, 6—6 respectively of FIG. 3.
Figure 6:
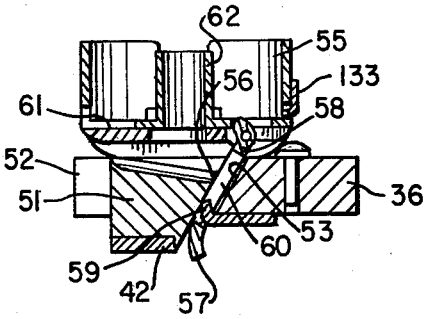

As reflected particularly in FIGS. 1 and 5, the bobbin case is provided with an edge opening slot 131 in its side wall 132, which terminates underneath a thread tension spring 133 mounted on the bobbin case by a screw 134 and adjustable by a tension set screw 135. In the vicinity of the end extremity of the thread tension spring 133, the bobbin case is provided with an enlarged opening 136 (see FIG. 1) which receives the end of the spring. The tension spring itself is modified at its end extremity to provide a slight hook portion 137, projecting toward the closed end of the bobbin case.

The location of the edge opening slot 131 is such that, when the bobbin case is initially applied over the filled bobbin in the winding station, the thread section T3 extending from the bobbin toward the source is received in the slot opening. With the bobbin case thus positioned, as a result of advancement of the transfer arm assembly 14, the rack 108 is actuated in an upward direction by the cylinder 109, rotating the control ring 106 in a clockwise direction. As shown particularly in FIG. 7, the control ring has a lug 140 carrying a rock shaft 141, on which is mounted a thread guiding wire 142. One end 143 of this wire is hooked around and confined by a cam wire 144 of generally semicircular shape, which is secured to the frame plate 19 at 145, 146. Also mounted on the control ring 106, alongside the free end 147 of the guide wire 142, is a thread engaging lug 148. As shown particularly in FIG. 7, the lug 148 projects outward from the control ring far enough to engage the thread section T3. When the control ring is rotated, the lug 148 picks up the thread span T3 and drives it toward the blind end of the bobbin case slot 131, forcing the thread under the tension spring 133 and then along the outer wall of the bobbin case to the enlarged opening 136. At this stage of control ring rotation, the hook portion 143 of the guide wire reaches an inclined portion 150 of the cam wire 144, and the free end 147 of the guide wire is caused to pivot outward, toward the closed end of the bobbin case. This causes the thread to be pushed out around the hooked end portion 137 of the tension spring and to be engaged by that hook. The thread is now under complete control in the bobbin case, ready for transfer to the sewing position.

With the thread thus controlled by the bobbin case, the transfer arm mechanism 14 can be retracted to its outer limit position and then rotated in a clockwise direction (as viewing from left to right in FIG. 1).

Just after retraction of the transfer arm assembly 14 with a filled bobbin, and prior to rotation of the assembly, the thread extends in the manner reflected at T4 in FIG. 2, from the thread guide 120 to the hook 137 on the bobbin case tension spring. As the transfer arm is now rotated, the bobbin case travels through an arc passing radially outside of the guide finger 121, so that as the bobbin case travels in an upward arc, the thread T4 is engaged by the finger 121, and the thread slides along the finger until it is picked up in the notch 151.

When the filled bobbin reaches the uppermost limit of travel, after 180° of rotation of the transfer arm assembly, the assembly is advanced to move the bobbin case in towards the loading position in the sewing machine. When the loaded bobbin case is in its uppermost position, the thread extends from the guide finger notch 151 upward in the general direction reflected by the thread T5 in FIG. 7. With the thread in this position, as the transfer arm assembly 14 is advanced, the thread is in line for engagement by thread clamp 122, consisting of a fixed mandrel 152 and the clamping plate 153. The plate 153 is carried by a slide pin 154 and urged in a closing direction by a spring 155. The mandrel and clamping plate 152, 153 which may advantageously be of annular form, are tapered toward their abutting surfaces, so as to assist in guiding the thread toward the clamping surfaces.

Figure 11:
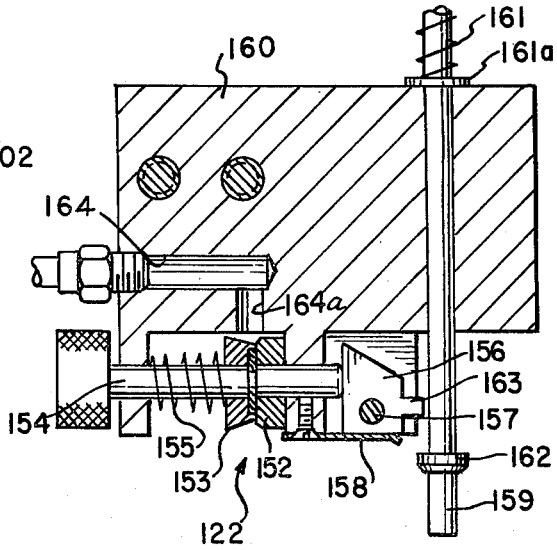
FIG. 11 is an enlarged, fragmentary cross sectional view as taken generally on line 11—11 of FIG. 7.

Actuation of the thread clamp 122 is effected by a lever 156 (FIG. 11) pivoted on a vertical pin 157 and bearing against the end of the clamp slide pin 154. A leaf spring 158 normally maintains the lever 156 in a neutral position, enabling the spring 155 to maintain clamping pressure on the elements 152, 153.

An operating plunger 159 is slideably received in a base member 160, which mounts the clamping elements. The plunger is spring-urged in a forward direction by means of a compression spring 161 acting against a snap ring 161*a*, which also serves as a forward limit stop. A shoulder 162 on the outer portion of the operating plunger 159 is positioned to engage a trip arm 163 on the clamp operating lever 156, upon inward movement of the plunger 159. When the transfer arm assembly is advanced toward the sewing machine, the upper carrier arm comes into engagement with the plunger 159 and, with continued advancing movement, causes the plunger to be depressed sufficiently to carry the shoulder 162 to and beyond the trip arm 163. This serves momentarily to open the clamping plate 153, then allowing it to close again as the shoulder travels past the trip arm and permits it to return. Upon return movement of the transfer arm, the plunger shoulder 162 engages the trip arm again, pivoting the operating lever in the opposite direction without affecting the clamp 122.

When the transfer arm approaches the sewing machine to pick up an empty bobbin, the short, residual thread section, broken away from the bobbin at the initiation of the rewinding operation, but retained in the clamp, is now released by momentary opening of the clamp. This short section is removed from the area by means of an air jet blowing through a passage 164 and discharged through a passage 164*a* directed at the clamping surfaces. Conveniently, the air jet is controlled by a valve 170 (see FIG. 8) operated by a cylindrical cam 171 carried on the transfer shaft 20. When the transfer shaft moves in an advancing direction, the valve is released and opened, so that a continuous jet air is provided until the transfer shaft returns to a retracted position. Thus, the instant the clamping elements are opened, the preexisting air jet blows away the old thread section. When the transfer arm assembly 14 approaches the sewing machine with a filled bobbin, a control thread section (T5 in FIG. 7) is carried to the thread clamp 122. As this control thread section comes into contact with the clamping jaws, the clamp is momentarily opened, and then reclosed, by the advancing movement of the plunger 159. The control thread is then secured in preparation for a further rewinding operation and can be separated from the previously wound bobbin.

As shown in FIG. 2, a thread cutting blade 172 is mounted above and slightly behind the thread clamp 122, preferably set on an angle relative to the axis of the transfer shaft 20. Thus, almost immediately after opening and reclosing of the thread clamp to receive a new thread section, the thread contacts the cutting edge 172 and is cut. To assure complete reliability of the cutting operation, each of the carrier arms 35, 36 mounts a cutting bracket 173. These brackets include plates 174, 175 positioned to straddle the cutting blade 172. In addition, the upper plate 175 has a guide notch (not shown) therein for maintaining the thread against sideways displacement. Accordingly, as the transfer arm assembly reaches the limit of its advancement, the thread is forced over the sharp edge of the cutting blade 172 and severed. The end of the thread above the blade hangs loose, leading downward from the bobbin case, in an appropriate position for the starting of a new sewing operation in the sewing machine. The lower section of the thread is retained in the thread clamp 122 and extends around the guide finger 121, through the circular thread guide 120 and back to the thread tensioning means and supply cone.

As will be understood, while a filled bobbin is being installed in a sewing machine, as just described, the empty bobbin has been separated from its bobbin case and mounted in a rewind station 15, as described earlier, and is ready for refilling.

SUMMARY OF OPERATION

In accordance with the invention, a sequence of sewing operations with the sewing machine is controllably interrupted after a predetermined number of sewing operations, when it is known that at least some thread will remain in the bobbin. The transfer arm apparatus is then actuated, advancing the transfer arm assembly into its pickup position. At the sewing station, the arm picks up the empty bobbin and its bobbin case, while at the rewind station, the bobbin case is already on the transfer arm and picks up only the bobbin. The bobbin case in the sewing position is released by manipulation of the locking lever, to open the bobbin case latch and free it from the sewing machine spindle. The empty bobbin spool is retained with the bobbin case by means of a low powered magnet 63 which extends through a cut out in the side of the bobbin case. At the rewind station, a relatively high power magnet, which retains the bobbin in the rewind station while it is being refilled, is disabled to release the bobbin spool and enable it to be attracted to a low power magnet on the transfer arm.

Before the transfer arm is retracted with the fully wound bobbin from the winding position, the thread, extending to the filled bobbin from the supply tensioner, is manipulated to be placed under the bobbin case tension spring and is then engaged about a special hook end portion of the spring. After the thread is thus engaged, the transfer arm assembly is retracted, rotated through 180°, and then advanced to bring the newly filled bobbin into position in the sewing machine. When this transfer has been completed, the thread from the bobbin has automatically been severed a short distance from the bobbin case. The locking lever is then released, on the upper carrier arm, so that the bobbin is released and becomes latched into the sewing machine. A new sequence of sewing operations may commence immediately. The severed thread remains clamped adjacent the area in which it is cut, so that the thread supply from the source is at all times under complete control.

At the rewind station, the bobbin is received over the pilot sleeve, and the magnetic switch is rotated to align the magnetic conductors with the poles of the magnet, strongly attracting the bobbin onto the rewinding station. When the transfer arm mechanism retracts, the rewinding activity commences at the lower station while the sewing operations proceed on the sewing machine.

As soon as the transfer arm mechanism has been retracted, the "empty" bobbin is reversely rotated and the residual thread is extracted therefrom by vacuum. The bobbin is then rotated in the desired rewinding direction, at which time the thread guide 120 momentarily deflects the thread against the outer face of the bobbin and causes it to be engaged by an edge-opening slot in the bobbin. The desired thread content on the rewound bobbin is provided by appropriate controls, preferably direct measurement of the linear yardage of the thread.

The short section of thread extending from the bobbin cone up to the clamp at the commencement of the rewind sequence is quickly frayed and broken. The broken off end is subsequently discarded when the clamp is reopened during the next exchange cycle.

The system of the invention is particularly advantageous, in that it enables a relatively simplified, compact mechanism to be installed directly at the front of an industrial sewing machine, under the sewing platform, to enable a virtually uninterrupted sequence of sewing operations to proceed, repetitively cycling a pair of bobbins, with one bobbin being automatically refilled and readied while the other is in use. The system of the invention also can be retrofitted to existing industrial sewing machines, providing for a significant improvement in the overall efficiency of the operation.

It should be understood, of course, that the illustrated form of the invention is intended to be representative only, as certain changes may be made therein without departing from the clear teachings of the disclosure. Accordingly, reference should be made to the following appended claims in determining the full scope of the invention.

We claim:

1. In a two-station bobbin replenishing system for use with an industrial type lock stitch sewing machine and including a transfer member mounted for axial motion, for bobbin pickup and deposit, and for rotational movement, for effecting bobbin exchange, an improved means for carrying a bobbin and bobbin case characterized by a. means on the transfer member for controllably engaging and retaining a bobbin case, b. said bobbin case having an open end for receiving and discharging bobbins and having an opening in its closed end exposing a portion of the bobbin end wall, and c. a magnetic element carried by said transfer member and projecting through said opening into close proximity to said bobbin end wall to releasably retain said bobbin in its bobbin case.

2. The system of claim 1, further characterized by a. said means for controllably engaging and retaining a bobbin case comprising a cam element operative to lift and grip the latching lever of a bobbin case.

3. In a two-station bobbin replenishing system for use with an industrial type lock stitch sewing machine and including a transfer member mounted for axial motion, for bobbin pickup and deposit, and for rotational movement, for effecting bobbin exchange, an improved locking and retaining means for the bobbins and bobbin cases, characterized by a. the transfer member having a carrier arm for each bobbin, b. a locking lever mounted for limited pivoting movement on each carrier arm and having a lifting cam engageable in lifting relation with the latch lever of a bobbin case, c. the carrier arms being recessed to receive said lifting cams and cooperating with said lifting cams to lockingly receive an open bobbin case latch lever and thereby to retain the case, whereby operation of said locking levers in a closing direction functions to release a bobbin case from a sewing machine and to secure the case to the transfer member for manipulation.

4. The system of claim 3, further characterized by a. said lifting cams having lifting surfaces disposed at a large angle to the normal plane of the bobbin case latch lever and having a relatively sharp leading edge to enable said latch lever to be engaged and lifted by movement of the locking lever, b. said carrier arms having edge opening recesses for receiving the lifting cams, c. the closed end surfaces of said recesses being generally opposed to the lifting surfaces of said cams, whereby said latch levers may be gripped and confined in said recesses.

5. A bobbin rewinding mechanism comprising a. a rewind shaft having an exposed end adapted to receive a bobbin, b. means forming a support surface for said bobbin for axially positioning the bobbins during rewind operations, c. a controllable first magnetic member positioned behind said surface and operative to attract said bobbin toward the rewind position, and d. second magnetic means for engaging and removing said bobbin from said rewind position.

6. The bobbin rewind mechanism of claim 5, further characterized by a. said controllable first magnetic means comprising a permanent magnet member having a plurality of poles, b. a set of magnetic conductor elements movable alternatively into aligned or non-aligned positions with respect to said poles, c. said conductor elements being positioned between said magnet member and said winding position.

7. The bobbin rewind mechanism of claim 6, further characterized by a. said magnet member being of generally cup-like configuration, slotted to form axially facing poles, b. said rewind shaft extending axially through said magnet members, c. a magnet control member mounted for rotation about the axis of said shaft and positioned between the ends of said poles and said winding position, d. said control member mounting said magnetically conductive members.

8. The method of effecting bobbin exchange and refilling on a continuous basis, which comprises a. rewinding an empty bobbin in a rewind station, b. combining the rewound bobbin with its case at the rewind station and engaging a used bobbin and bobbin case for removal from the sewing position, c. simultaneously rotating the respective bobbin and bobbin case assemblies 180° about an axis midway between them, d. maintaining the thread attached to the rewound bobbin throughout at least a substantial portion of said 180° rotation, e. clamping the thread leading to said rewound bobbin and then severing the thread between the bobbin and the point at which the thread is clamped, f. positioning the used bobbin in the rewind station, and g. commencing a further bobbin rewind operation by rotating the used bobbin while pressing the clamped thread section against the side of the rotating bobbin, h. the bobbin having an edge opening slot in its end wall for engaging the pressed thread.

9. The method of claim 8, further characterized by a. the clamped section of thread being yieldably tensioned between the clamping point and the used bobbin in the rewind station, whereby said section of thread is frayed and broken by the rotational motion of a bobbin during rewinding thereof.

10. The method of claim 8, further characterized by a. said used bobbin being initially rotated in the unwinding direction after positioning in the rewind station, and b. vacuum means being applied to said bobbin during said initial rotation to remove any residual thread.

11. A system for rewinding and reloading a bobbin in a sewing machine, which comprises a. a source of thread under tension, b. means for rotatably supporting a bobbin spool for rewinding, c. means for applying to the rewound spool an open end bobbin case, d. said bobbin case having an edge opening slot and a tension spring overlying the closed end of the slot, e. said means for applying being operative to orient said bobbin case such that the tensioned thread leading from said source enters said slot, f. a thread engaging lug mounted for movement along the outside of said bobbin case, in the area of said slot and operative to force the tensioned thread toward the closed end of said slot and under said tension spring.

12. The system of claim 11, further characterized by a. said tension spring having a hook-like end portion facing the closed end of the bobbin case, and b. a thread guide element is cooperatively associated with said thread engaging lug to lift the tensioned thread onto said hook-like portion.

13. A bobbin and bobbin case assembly for use in an automatic bobbin rewinding and exchange system, which comprises a. a bobbin case having an open end and a closed end and a cylindrical side wall, b. said bobbin case being formed with an access opening in one of its walls for the reception of a magnetic retainer, and c. a bobbin formed at least in part of magnetic material, d. said bobbin and bobbin case being so constructed and arranged that a magnetic part of said bobbin is disposed adjacent said access opening when said bobbin and bobbin case are assembled.

14. A bobbin rewinding system for a sewing machine, which comprises a. a bobbin rewinding shaft and means for effecting controllable rotation thereof, b. a bobbin spool adapted for reception on said shaft, c. said bobbin spool having one end wall formed with an edge opening slot for the reception of a thread, d. a source of thread under controlled tension, e. means for guiding said thread adjacent to but out of contact with the slotted side wall of said bobbin spool, and f. movable thread guide means operable to displace said guided thread into contact with said slotted side wall while said bobbin is being rotated, whereby said thread is engaged by and wound upon said bobbin.

15. The system of claim 14, further characterized by a. an open sided bobbin case, b. means for applying said bobbin case over a rewound bobbin, c. said bobbin case having an edge opening slot in its side wall and a tension spring partially covering said slot, d. thread engaging means engageable with the tensioned thread, after rewinding and application of the bobbin case over a wound bobbin, and movable to urge the tensioned thread under said tension spring, and e. means for transporting said bobbin and bobbin case substantially to a sewing position while said bobbin case remains attached to said tensioned thread.

16. A bobbin rewinding and exchange system for use in connection with a sewing machine, comprising a. a transfer arm assembly for simultaneously engaging a pair of bobbins and exchanging them between sewing and rewinding positions, b. a shaft mounting said transfer arm assembly for unidirectional rotation in 180° increments and for axial movement between retracted and advanced positions, c. first clutch-like means engaging said transfer arm assembly to said shaft when said assembly is in a retracted position, d. second clutch-like means for retaining said transfer arm assembly in a fixed rotational orientation when said assembly is in an advanced position, e. means for effecting rotation of said shaft in a forward direction when said transfer arm assembly is in a retracted position, and f. means for effecting rotation of said shaft in a reverse direction when said transfer arm assembly is in an advanced position.

* * * * *